US009378630B2

(12) United States Patent
Smith

(10) Patent No.: US 9,378,630 B2
(45) Date of Patent: Jun. 28, 2016

(54) METHOD FOR PREVENTING INPUT ON AN APPARATUS HAVING A USER INTERFACE

(71) Applicant: Whirlpool Corporation, Benton Harbor, MI (US)

(72) Inventor: Blayne C. Smith, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 9 days.

(21) Appl. No.: 14/315,816

(22) Filed: Jun. 26, 2014

(65) Prior Publication Data

US 2015/0097691 A1 Apr. 9, 2015

Related U.S. Application Data

(60) Provisional application No. 61/888,018, filed on Oct. 8, 2013.

(51) Int. Cl.

| | |
|---|---|
| ***G08B 21/00*** | (2006.01) |
| ***G08B 3/10*** | (2006.01) |
| ***A47L 15/00*** | (2006.01) |
| ***A47L 15/42*** | (2006.01) |
| *G08B 5/36* | (2006.01) |

(52) U.S. Cl.

CPC ..... *G08B 3/10* (2013.01); *A47L 15/0049* (2013.01); *A47L 15/4257* (2013.01); *A47L 2401/26* (2013.01); *A47L 2501/26* (2013.01); *A47L 2501/32* (2013.01); *G08B 5/36* (2013.01)

(58) Field of Classification Search

CPC .... C08F 283/01; C08F 222/1006; C08F 4/02; C08F 20/20; C08F 22/105; C08F 36/20; C09J 4/00; A47L 15/4259; A47L 15/4293; A47L 2401/26; A47L 2501/26; A47L 2501/32; B82Y 25/00; B82Y 10/00

USPC ..... 340/686.2, 686.3, 691.6, 825.23, 5.55, 340/7.32, 10.52, 10.3, 815.86

See application file for complete search history.

(56) References Cited

U.S. PATENT DOCUMENTS

| | | | | |
|---|---|---|---|---|
| 5,810,660 | A * | 9/1998 | Lee | F24F 13/06 454/233 |
| 6,530,100 | B2 * | 3/2003 | Conrath | D06F 37/24 68/12.06 |
| 6,746,009 | B2 * | 6/2004 | Engarto | B65H 5/023 198/457.03 |
| 8,505,593 | B1 * | 8/2013 | Denise | F25C 5/005 141/198 |
| 2009/0001069 | A1 * | 1/2009 | Bally | F24C 15/027 219/413 |
| 2009/0056773 | A1 | 3/2009 | Son et al. | |

FOREIGN PATENT DOCUMENTS

| | | | |
|---|---|---|---|
| EP | 2 599 424 | * | 6/2013 |
| EP | 2599424 | A1 | 6/2013 |

* cited by examiner

*Primary Examiner* — Daniel Previl

(57) ABSTRACT

A method for preventing input and/or interaction on an apparatus having a user interface (UI) with input elements located on a door rotatable about an axis relative to an earth horizontal, the method includes detecting the horizontal position of the door and disabling input from the UI input elements based on the horizontal position of the door.

12 Claims, 1 Drawing Sheet

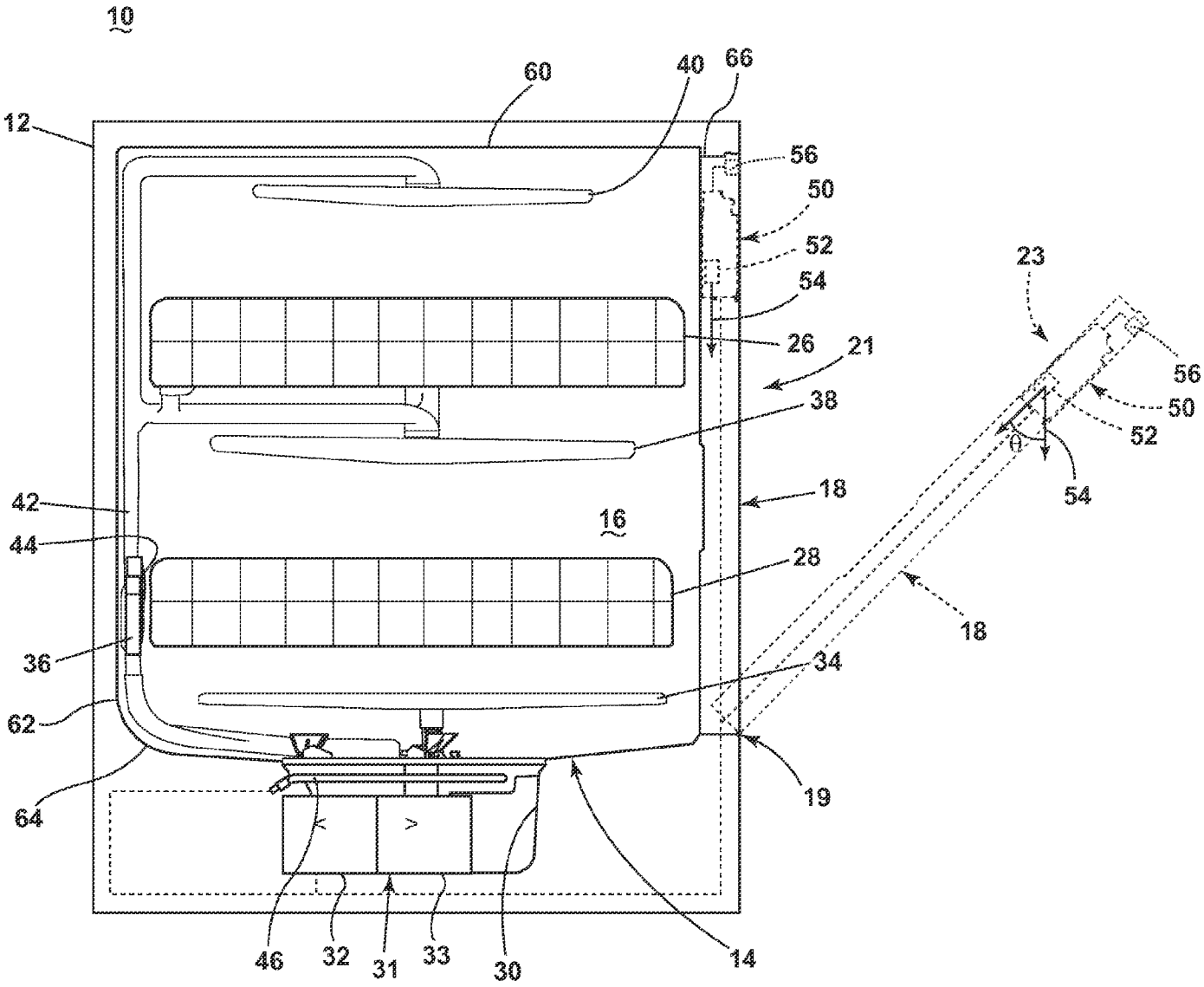
10
12
14
16
18
19
21
23
26
28
30
31
32
33
34
36
38
40
42
44
46
50
52
54
56
60
62
64
66
θ

METHOD FOR PREVENTING INPUT ON AN APPARATUS HAVING A USER INTERFACE

CROSS-REFERENCE TO RELATED APPLICATIONS

This application claims the benefit of U.S. Provisional Patent Application No. 61/888,018, filed Oct. 8, 2013, which is incorporated herein by reference in its entirety.

BACKGROUND OF THE INVENTION

A user interface is a device where interaction between users and machines occurs. The interaction may provide uni- or bi-directional communication between the user and the machine, for example, by allowing the user to control operation of the machine on the user's end, and by allowing the machine to provide feedback or information to the user.

BRIEF DESCRIPTION OF THE INVENTION

In one aspect, a method for preventing input on an apparatus having a user interface (UI) with input elements located on a door rotatable about an axis relative to an earth horizontal, the method includes detecting the horizontal position of the door using an accelerometer operably carried by the door and measuring acceleration in at least one direction, comparing the detected horizontal position with a threshold horizontal position, and disabling input from the UI input elements if the detected horizontal position satisfies the threshold.

BRIEF DESCRIPTION OF THE DRAWINGS

In the drawings:

FIG. 1 is a schematic, cross-sectional view of a dishwasher according to a first embodiment of the invention.

DESCRIPTION OF EMBODIMENTS OF THE INVENTION

While the invention may be implemented in any apparatus or device having a user interface (UI) for providing interaction between a human user and a machine, it is currently exemplified to be implemented in a home appliance, for example, a dishwasher. Thus, a brief summary of the contemplated environment should aid in a more complete understanding.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18 about an axis 19 relative to an earth horizontal. When the door assembly 18 is closed (illustrated as a first position 21), user access to the treating chamber 16 may be prevented, whereas user access to the treating chamber 16 may be permitted when the door assembly 18 is open (illustrated as a dotted second position 23).

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system may be provided for spraying liquid in the treating chamber 16 and may be provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold may be set forth in detail in U.S. Pat. No. 7,594,513, issued Sep. 29, 2009, and titled "Multiple Wash Zone Dishwasher," which may be incorporated herein by reference in its entirety.

A recirculation system may be provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door assembly 18 as illustrated, or it may alternatively be located somewhere within the chassis 12. The controller 50 further includes an acceleration sensor 52 fixedly and electrically coupled with the controller 50 and configured to measure acceleration in at least one direction. As shown, the acceleration sensor 52 may provide a measured acceleration value, illustrated as a vector 54, in at least the gravitational acceleration direction. The acceleration sensor 52 may be operably carried by the door assembly 18 via the coupling such that movement of the door assembly 18 about the axis 19 produces measurable changes in the sensor 52.

The acceleration sensor 52 may provide a raw vector 54 to the controller 50, or the sensor may provide a relative vector 54 value, for instance, the angle of door position (illustrated as θ) relative to a closed position 21. Alternatively, the controller 50 may compute a relative vector 54 value from the raw vector 54. The acceleration sensor 52 may also measure more than one direction, or include a plurality of sensors for measuring the plurality of directions. In this configuration, the vector 54 may represent the plurality of directions, or additional vectors may represent the plurality of directions. Additionally, alternate door locations are envisioned for the acceleration sensor 52, such as away from the controller 50.

The controller 50 may also be operably coupled with a control panel or user interface (UI) 56 for receiving user-selected inputs and communicating information to the user. The UI 56 may include operational controls or input elements such as dials, lights, switches, buttons, and displays enabling a user to input commands, such as a cycle of operation, to the controller 50 and receive information. Additionally the UI 56 may include output elements such as lights, speakers, or vibration devices to enable the controller 50 to provide responsive information from the dishwasher 10 to the user.

When the dishwasher 10 door is in a closed position 21, the various aforementioned dishwasher 10 components are operatively controlled by the controller 50 to perform at least one cycle of operation to clean dishes or utensils placed in the treating chamber 16. The controller 50 may have a plurality of different cycles of operation (e.g. heavy wash, normal wash, heated dry, etc.) which may be controlled by the input elements of the UI 56. In this sense, a user uses the UI 56 to select the cycle of operation, and start the operation of the dishwasher 10.

The controller 50 may further prevent input on the UI 56 based on the position of the door assembly 18 in order to inhibit the dishwasher 10 from selecting or the controlling of any variables via the UI 56, or starting a cycle of operation, when the door is in an open position 23. For instance, the acceleration sensor 52 may detect the horizontal position of the door assembly 18, or the horizontal levelness of the door assembly 18 (relative to the axis 19 of door 18 rotation), by measuring the acceleration vector 54, and supplying a signal indicative of the vector 54 to the controller 50. The controller 50 may compare the detected horizontal position of the door assembly 18 with a threshold horizontal position, such as a predetermined threshold or a reference threshold position, which may be stored in a memory. If the comparison satisfies the threshold horizontal position, the controller 50 may disable input from the UI 56, and thus, disable operation of the dishwasher 10. Stated another way, when the controller 50, reading a signal from the acceleration sensor 52, determines the door may be opened too wide, it will control the UI 56 such that any input, errant or purposeful, may be disabled.

The controller 50 may disable input from the UI 56 input elements by a plurality of methods. For instance, the controller 50 may control the UI 56 such that the UI 56 may be disabled, partially or completely, for instance, by disabling power. In another instance, the controller 50 may control the UI 56 such that the UI 56 may be enabled, but any inputs registered on the input elements are ignored. Additionally an embodiment of the invention is envisioned wherein less than all of the UI 56 input elements are disabled.

In the above described instances, either the UI 56 or the controller 50 may further provide an alert to the user, via one of the output elements, to notify the user that an input was registered, but ignored. The alert may be audible, for example, by producing a sound from the speaker, or it may be visual, for example, by flashing an error light indicator. Additional alerts, or combinations of alerts, are envisioned to provide the user notification that an input to the UI 56 has been disabled. Additional methods of disabling input from the UI 56 input elements are envisioned.

The controller 50 and/or UI 56 may be configured to, for instance, perform the method described above each time an input may be provided to the UI 56, regardless of the position of the door assembly 18. Alternatively, the method described above may be operated continuously regardless if an input is provided to the UI 56. Additional configurations to perform the method are envisioned.

Many other possible embodiments and configurations in addition to that shown in the above FIGURES are contemplated by the present disclosure. For example, one embodiment of the invention contemplates a washing or drying appliance that has a horizontal or vertical opening door which opens, for example, configured to pivot about a respective horizontal or vertical axis. Additional non-limiting examples of home appliances may include refrigerators, ovens, or anything other apparatus with similar door and UI elements as described above.

The embodiments disclosed herein provide a method for preventing input on an apparatus having a user interface. One advantage that may be realized in the above embodiments may be that the above described embodiments prevent errant or unintended user interface input from a user when the apparatus may be in a state wherein the operation of the input may not be acted upon, for example, by preventing a cycle of operation when a door is opened. The method additionally prevents errant or unintended user interface input from any interaction with objects other than a user, such as pets, chairs, walls, or any other physical intrusion that might come in contact with the user interface input. Another advantage that might be realized may be that the above described embodiments provide a more robust user interface wherein a user will not be frustrated by errant or unintended user interface input while the apparatus is in a state wherein the operation of the input may not be acted upon. This results in an overall improved user experience. Yet another advantage that might be realized in the above embodiments may be that the above described embodiments may allow for energy savings by reducing the amount of time a user interface must be powered and polling for interaction. Even yet another advantage to the above described embodiments may be that by providing an alert to the user of input during a user interface input disabling provides the user with feedback something is or has been in contact with an input, and allows them an opportunity to prevent that contact.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for preventing input on an apparatus having a user interface (UI) with input elements located on a door rotatable about an axis relative to an earth horizontal, the method comprising:

detecting the horizontal position of the door using an accelerometer operably carried by the door and measuring acceleration in at least one direction;

comparing the detected horizontal position with a threshold horizontal position; and disabling input from the UI input elements if the detected horizontal position satisfies the threshold horizontal position.

2. The method of claim 1 wherein the accelerometer measures acceleration in at least a gravitational direction.

3. The method of claim 1 wherein the accelerometer measures acceleration in a plurality of directions.

4. The method of claim 3 wherein at least one of the plurality of directions is a gravitational direction.

5. The method of claim 1 wherein comparing the detected horizontal position with the threshold horizontal position further comprises a comparison of the detected horizontal position with a reference threshold position.

6. The method of claim 1 wherein disabling input from the UI input elements comprises disabling the UI.

7. The method of claim 1 wherein disabling input from the UI input elements comprises ignoring UI input element signals.

8. The method of claim 1, further comprising alerting the user of the input.

9. The method of claim 8 wherein alerting the user comprises at least one of an audible or visual indication of the input.

10. The method of claim 1 wherein disabling input further comprises preventing a starting of a cycle of operation.

11. The method of claim 1 wherein detecting the position of the door comprises detecting the position of a door for a dishwasher.

12. The method of claim 1 wherein detecting the position of the door comprises detecting a levelness of the door with respect to an axis of door rotation.

* * * * *